US009784282B2

(12) United States Patent
Robson et al.

(10) Patent No.: US 9,784,282 B2
(45) Date of Patent: Oct. 10, 2017

(54) COMPRESSOR

(71) Applicant: Dyson Technology Limited, Wiltshire (GB)

(72) Inventors: Donald Victor Robson, Swindon (GB); Gary King, Caerphilly (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 493 days.

(21) Appl. No.: 14/268,810

(22) Filed: May 2, 2014

(65) Prior Publication Data

US 2014/0328676 A1 Nov. 6, 2014

(30) Foreign Application Priority Data

May 3, 2013 (GB) ..... 1308094.0

(51) Int. Cl.

| | |
|---|---|
| ***F03B 1/00*** | (2006.01) |
| ***F04D 29/44*** | (2006.01) |
| ***F04D 29/62*** | (2006.01) |
| ***F04D 29/60*** | (2006.01) |

(52) U.S. Cl.
CPC ..... *F04D 29/444* (2013.01); *F04D 29/60* (2013.01); *F04D 29/624* (2013.01)

(58) Field of Classification Search
CPC ... F04D 29/059; F04D 29/584; F04D 29/5853
See application file for complete search history.

(56) References Cited

U.S. PATENT DOCUMENTS

| | | | | |
|---|---|---|---|---|
| 4,403,914 | A | 9/1983 | Rogo et al. | |
| 4,611,969 | A | 9/1986 | Zinsmeyer | |
| 4,718,819 | A | 1/1988 | Rogo et al. | |
| 5,427,498 | A * | 6/1995 | Lehe | F04D 29/167 415/106 |
| 6,129,524 | A * | 10/2000 | Woollenweber | F04D 17/12 417/366 |
| 8,096,126 | B2 * | 1/2012 | Shibui | F02B 37/025 123/559.1 |
| 2005/0158173 | A1 | 7/2005 | Nguyen et al. | |
| 2010/0215485 | A1 | 8/2010 | Childe et al. | |
| 2011/0189011 | A1 | 8/2011 | Claus et al. | |

FOREIGN PATENT DOCUMENTS

| | | |
|---|---|---|
| DE | 34 24 925 | 10/1985 |
| DE | 44 38 611 | 5/1996 |
| EP | 0 134 748 | 3/1985 |

(Continued)

OTHER PUBLICATIONS

Search Report dated Nov. 11, 2013, directed to GB Application No. 1308094.0; 1 page.

(Continued)

*Primary Examiner* — Jesse Bogue
(74) *Attorney, Agent, or Firm* — Morrison & Foerster LLP

(57) ABSTRACT

A compressor that includes an impeller, a diffuser and a shroud. The diffuser includes vanes and one or more projections, each of which extends from a top of a vane. The shroud includes one or more holes. The shroud covers the impeller and the diffuser such that each projection protrudes through one of the holes. The shroud is then secured to the projections by an adhesive.

9 Claims, 4 Drawing Sheets

(56) References Cited

FOREIGN PATENT DOCUMENTS

| | | |
|---|---|---|
| FR | 2 960 603 | 12/2011 |
| GB | 2 190 429 | 11/1987 |
| GB | 2467964 | 8/2010 |
| JP | 54-131104 | 10/1979 |
| JP | 55-49095 | 3/1980 |
| JP | 59-65904 | 5/1984 |
| JP | 60-256504 | 12/1985 |
| JP | 62-251498 | 11/1987 |
| JP | 1-173301 | 12/1989 |
| JP | 6-193595 | 7/1994 |
| JP | 7-8596 | 2/1995 |
| JP | 2005-163751 | 6/2005 |
| JP | 2007-224866 | 9/2007 |
| WO | WO-2009/105208 | 8/2009 |
| WO | WO-2010/097606 | 9/2010 |

OTHER PUBLICATIONS

International Search Report and Written Opinion dated Jul. 21, 2014, directed to International Application No. PCT/GB2014/051295; 11 pages.
Childe et al., U.S. Office Action dated May 29, 2013, directed to U.S. Appl. No. 12/709,146; 8 pages.
Childe et al., U.S. Office Action dated Dec. 6, 2013, directed to U.S. Appl. No. 12/709,146; 7 pages.

* cited by examiner

COMPRESSOR

REFERENCE TO RELATED APPLICATION

This application claims priority of United Kingdom Application No. 1308094.0, filed May 3, 2013, the entire contents of which are incorporated herein by reference.

FIELD OF THE INVENTION

The present invention relates to a compressor.

BACKGROUND OF THE INVENTION

A known design of compressor comprises a centrifugal impeller and a vaned diffuser covered by a static shroud. The shroud is typically secured around its outer edge to a wall that surrounds the diffuser.

SUMMARY OF THE INVENTION

The present invention provides a compressor comprising an impeller, a diffuser and a shroud, wherein the diffuser comprises a plurality of vanes and one or more projections, each projection extends from a top of a vane, the shroud comprises one or more holes, the shroud covers the impeller and the diffuser such that each projection protrudes through a respective hole, and the shroud is secured to the projections by an adhesive.

The shroud is therefore secured directly to the top of diffuser rather than to a wall that surrounds the diffuser. As a result, the overall size of the compressor may be reduced. For example, the shroud may have the same outer diameter as that of the diffuser.

For a conventional compressor in which the shroud is secured to a wall surrounding the diffuser, air exiting the diffuser is turned axially. In contrast, with the compressor of the present invention, the shroud is secured to the top of the diffuser and thus air exiting the diffuser is free to continue in a radial direction. This may lead to performance benefits or may better suit the product in which the compressor is intended to be used.

The shroud may comprise a pair of concentric walls that delimit a trough within which the holes are located. The adhesive is then located around the trough. The trough has the advantage of containing the adhesive. The trough may be filled to a level that ensures that the adhesive covers the holes and the projections. Alternatively, a smaller amount of adhesive may be used, which is then spread around the trough so as to ensure that adhesive penetrates and fills each of the holes.

Each projection may extend from a first part of a vane, and the shroud may rest on a second part of the vane. This then has the advantage that the height of the vanes may be used to define the clearance between the shroud and the impeller. Additionally, the lengths of the projections may be defined so as to achieve a good securement between the shroud and the diffuser without the need for excessively large holes or an excessive amount of adhesive. Furthermore, a more compact compressor may be realised. In particular, the vanes may terminate at or near to the outer perimeter of the shroud.

The compressor may comprise a sealing ring that covers the holes and projections. The adhesive then creates a seal between the shroud and the sealing ring around the inner perimeter and the outer perimeter of the sealing ring. The sealing ring therefore creates a sealed enclosure over the holes and projections. Consequently, in the event that one or more of the holes are only partially filled with adhesive, the sealing ring nevertheless prevents any leaks.

The present invention also provides a compressor comprising an impeller, a diffuser and a shroud, wherein the diffuser comprises a plurality of vanes and one or more projections, the shroud comprises one or more holes, the shroud covers the impeller and the diffuser such that each projection protrudes through a respective hole, each projection extends from a first part of a vane, the shroud rests on a second part of the vane, and the shroud is secured to the projections by an adhesive.

Again, the shroud is secured directly to the top of the diffuser rather than to a wall that surrounds the diffuser. As a result, the overall size of the compressor may be reduced. Since the shroud rests on part of the vane, the height of the vanes may be used to define the clearance between the shroud and the impeller. Additionally, the manufacture and assembly of the compressor may be simplified by resting the shroud on the vanes of the diffuser whilst applying the adhesive between the shroud and the projections.

The shroud may comprise a pair of concentric walls that delimit a trough within which the holes are located. The adhesive is then located around the trough. The trough has the advantage of containing the adhesive. The trough may be filled to a level that ensures that the adhesive covers the holes and the projections. Alternatively, a smaller amount of adhesive may be used, which is then spread around the trough so as to ensure that adhesive penetrates and fills each of the holes.

The compressor may comprise a sealing ring that covers the holes and projections. The adhesive then creates a seal between the shroud and the sealing ring around the inner perimeter and the outer perimeter of the sealing ring. The sealing ring therefore creates a sealed enclosure over the holes and projections. Consequently, in the event that one or more of the holes are only partially filled with adhesive, the sealing ring nevertheless prevents any leaks.

The present invention further provides a method of assembling a compressor comprising: providing an impeller, a diffuser and a shroud, wherein the diffuser comprises a plurality of vanes and one or more projections, each projection extends from a top of a vane, and the shroud comprises one or more holes; covering the impeller and the diffuser with the shroud such that each projection protrudes through a respective hole; and applying an adhesive between the shroud and each projection so as to secure the shroud to the diffuser.

The shroud may comprise a pair of concentric walls that delimit a trough within which the holes are located, and the method may comprise applying the adhesive around the trough. For example, the method may comprise filling the trough to a level that ensures that the adhesive completely covers the holes and the projections. Alternatively, the method may comprise applying a bead of adhesive within the trough and then spreading the adhesive around the trough so as to fill the holes.

The method may comprise covering the holes and projections with a sealing ring such that the adhesive forms a seal around the inner perimeter and the outer perimeter of the sealing ring. As a result, the sealing ring creates a sealed enclosure over the top of the holes. It is not then necessary to ensure that each hole is filled completely with adhesive. This then has the advantage that less accurate control is required over the amount and location of the adhesive, and thus the method is better suited to use in an automated process.

The sealing ring may comprise an annulus and lips that extend downwardly from the inner perimeter and the outer perimeter of the annulus, and the method may comprise pressing the sealing ring into the adhesive such that the adhesive is driven towards the projections by the lips. The lips therefore serve two useful functions. First, the lips provide edge features around which the adhesive forms a seal. Second, the lips drive the adhesive towards the projections in a generally radial direction. This then helps achieve a good adhesive contact with the projections whilst reducing the risk of driving the adhesive axially down the holes and into the diffuser passage.

The adhesive may be applied as a first annular bead and a second annular bead, and the sealing ring may contact the first bead around its outer perimeter and contact the second bead around its inner perimeter. This then has the advantage that less adhesive is required to achieve the necessary seal around the inner and outer perimeters of the sealing ring, as well as the necessary securement between the shroud and the projections.

BRIEF DESCRIPTION OF THE DRAWINGS

In order that the present invention may be more readily understood, an embodiment of the invention will now be described, by way of example, with reference to the accompanying drawings, in which.

DETAILED DESCRIPTION OF THE INVENTION

Figure 1:
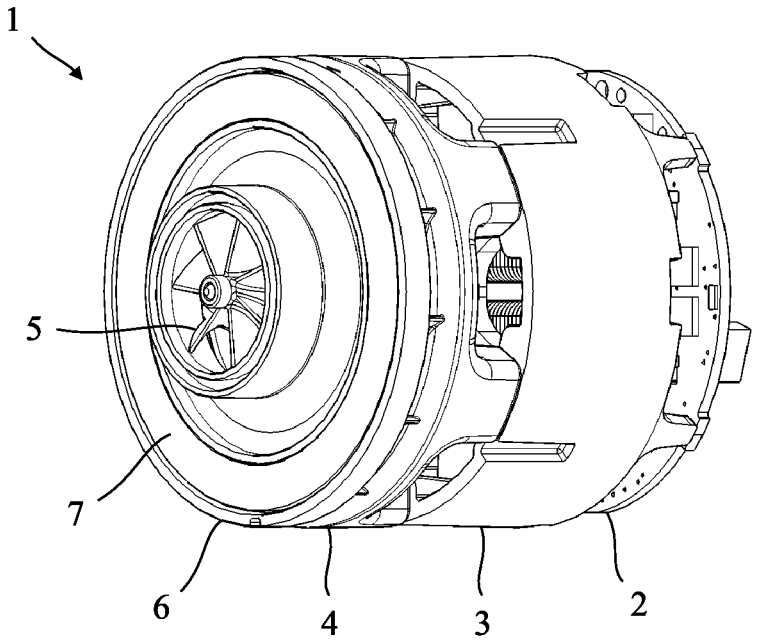
FIG. 1 is an axonometric view of a compressor in accordance with the present invention.
Figure 3:
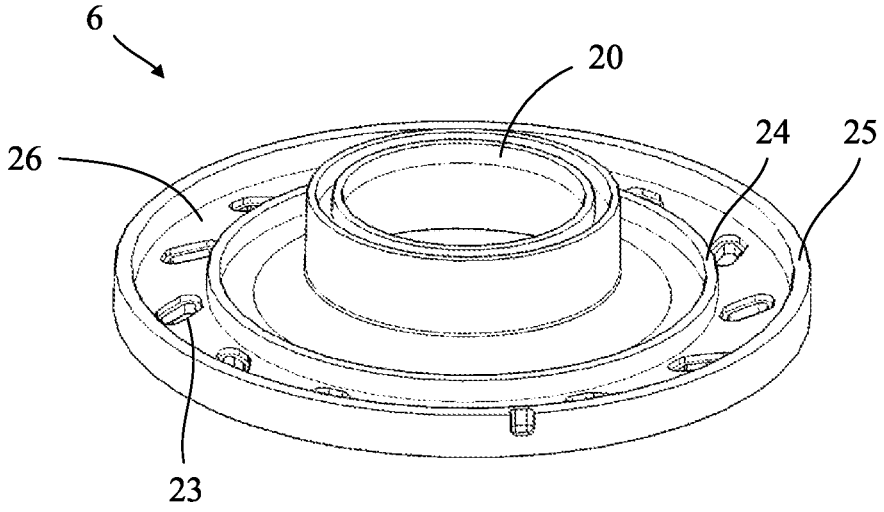
FIG. 3 is an axonometric view of a shroud of the compressor.
Figure 2:
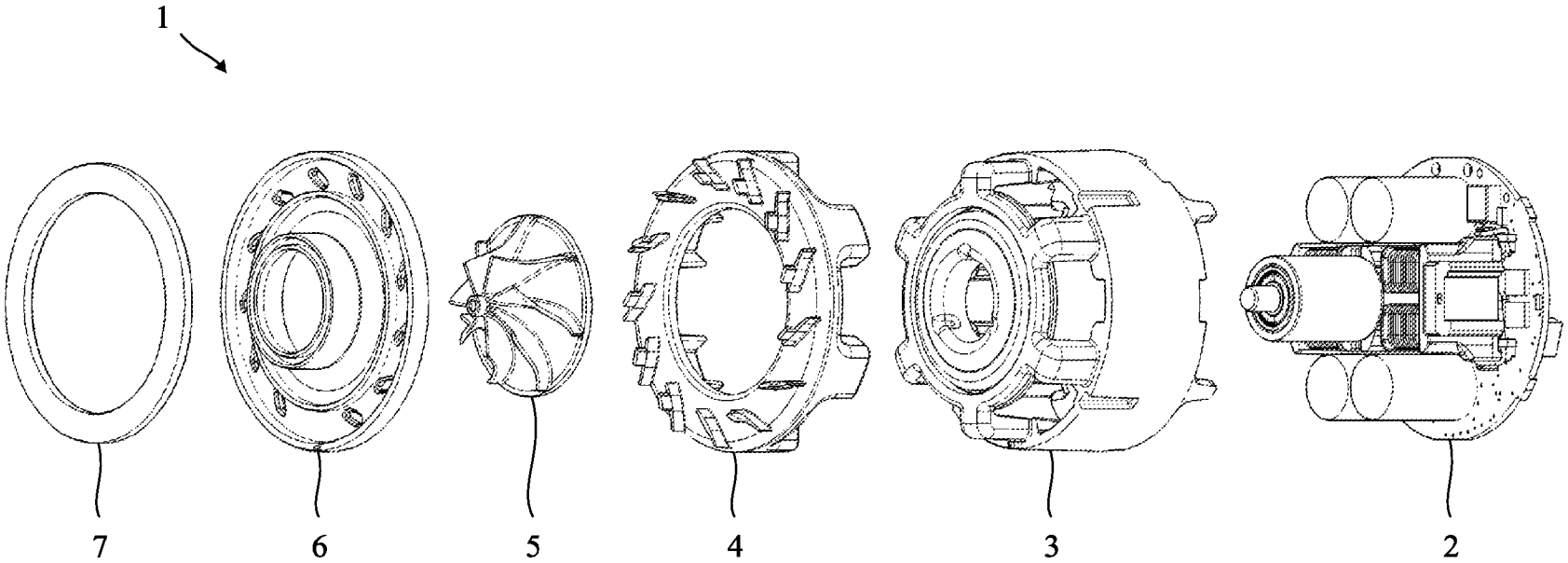
FIG. 2 is an exploded view of the compressor.
Figure 4:
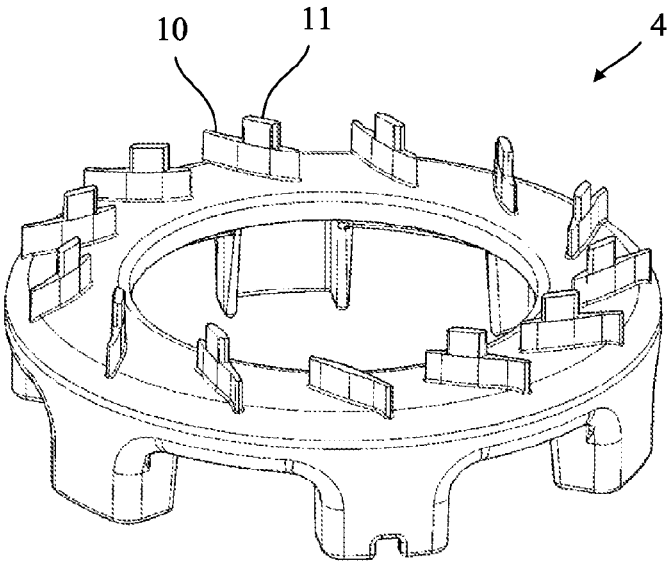
FIG. 4 is an axonometric view of a diffuser of the compressor.
Figure 5:
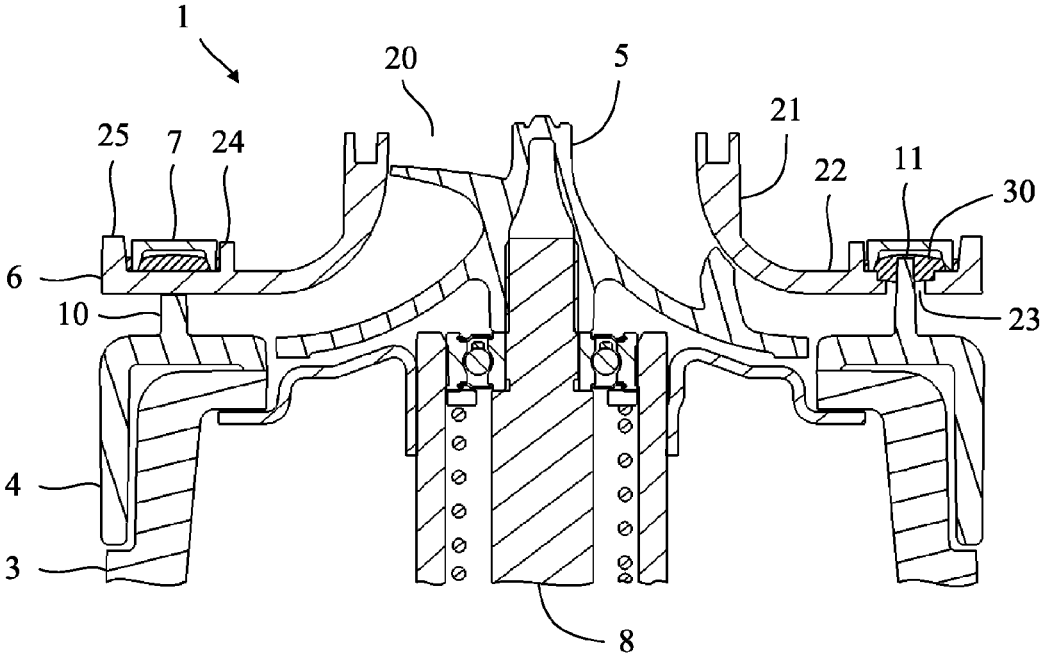
FIG. 5 is a sectional slice through the compressor in the region of the shroud and diffuser.

The compressor 1 of FIGS. 1 to 6 comprises an electric motor 2, a frame 3, a diffuser 4, an impeller 5, a shroud 6 and a sealing ring 7.

The electric motor 2 is secured within the frame 3 and comprises a shaft 8 to which the impeller 5 is mounted.

The diffuser 4 is mounted to an end of the frame 3 and comprises a plurality of vanes 10 and a plurality of projections 11. Each projection 11 extends from the top of a vane 10.

The impeller 5 is a semi-open centrifugal impeller.

The shroud 6 comprises an inlet 20, a flared inner section 21, a planar outer section 22, a plurality of holes 23 that extend through the outer section 22, and a pair of concentric walls 24,25 located on the upper surface of the outer section 22. The two walls 24,25 are located on opposite sides of the holes 23 and define a trough 26 within which the holes 23 are located. The shroud 6 covers the impeller 5 and the diffuser 4. More specifically, the flared inner section 21 covers the impeller 5 and the planar outer section 22 covers the diffuser 4. The outer section 22 rests on the top of the vanes 10 of the diffuser 4, and each projection 11 protrudes through a respective hole 23 in the shroud 6. The shroud 6 is secured to the projections 11 of the diffuser 4 by an adhesive 30 located within the trough 26.

The sealing ring 7 comprises an annulus 40 and two small lips 41,42 that extend downwardly from the inner and outer perimeters of the annulus 40. The sealing ring 7 is seated within the trough 26 of the shroud 6 and covers the holes 23 and the projections 11. The sealing ring 7 is secured to the shroud 6 by the adhesive 30 located within the trough 26. The adhesive 30 extends around the inner perimeter and the outer perimeter of the sealing ring 7. As a result, the sealing ring 7 provides a sealed enclosure over the holes 23 and the projections 11. As explained below, the adhesive 30 located within the trough 26 does not necessarily fill completely each of the holes 23 in the shroud 6. Without the sealing ring 7, a partially filled hole 23 would present an opening in the diffuser passage through which air would leak. The sealing ring 7, in providing a sealed enclosure over the holes 23, ensures that no leaks occur.

A method of assembling the compressor 1 will now be described.

Figure 6:
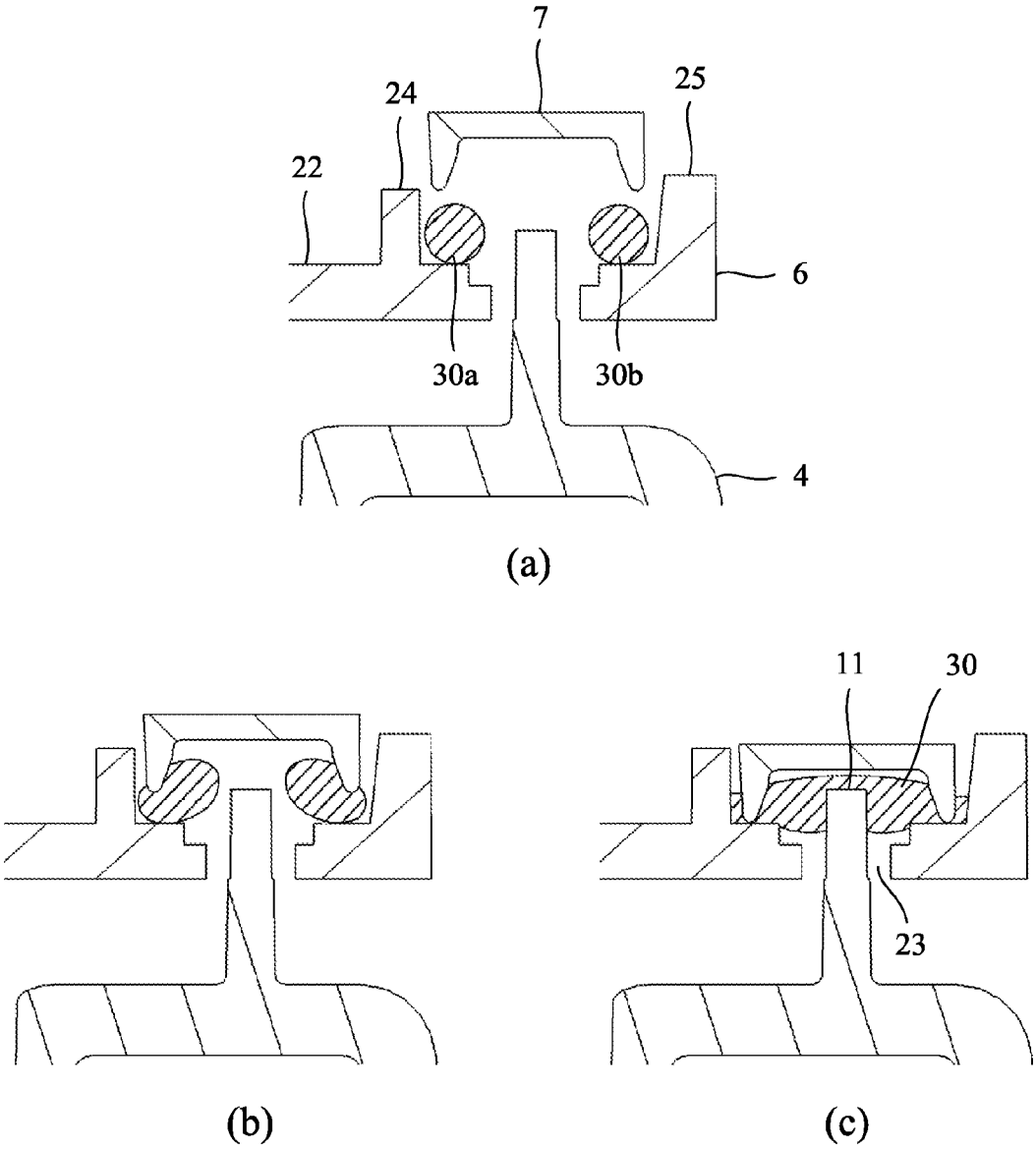
FIG. 6 illustrates different steps in the assembly of the compressor, wherein each view is a sectional slice through the compressor in the region of a hole in the shroud and a vane of the diffuser.

The shroud 6 is held in one part of a jig, and a sub-assembly comprising the motor 2, the frame 3, the diffuser 4 and the impeller 5 is held in another part of the jig. The manner in which the sub-assembly is assembled is not pertinent to the present invention. The two parts of the jig are brought together such that the shroud 6 covers the diffuser 4 and the impeller 5. The jig ensures relative alignment between the shroud 6 and the sub-assembly such that the shroud 6 rests on the tops of the vanes 10 of the diffuser 4 and each projection 11 protrudes through a hole 23 in the shroud 6. Adhesive 30 is then applied around the trough 26 in the shroud 6. As illustrated in FIG. 6, the adhesive 30 is applied as two annular beads 30*a*,30*b* around the inner perimeter and the outer perimeter of the trough 26, see FIG. 6(*a*). The adhesive 30 is relatively viscous. This then ensures that the adhesive 30 does not run down the vanes 10 of the diffuser 4 and into the diffuser passage. The sealing ring 7 is then pressed into the trough 26 in the shroud 6, see FIGS. 6(*b*) and (*c*). Each of the lips 41,42 of the sealing ring 7 is tapered. Consequently, as the sealing ring 7 is pressed into the trough 26, the adhesive 30*a*,30*b* is driven towards the centre of the trough 26 and over the top of the projections 11. This then ensures that a good adhesive bond between the shroud 6 and each of the projections 11. The assembly is then left for several minutes in order to cure the adhesive 30, after which time the assembled compressor 1 is removed from the jig.

With a conventional compressor, the shroud typically extends beyond the diffuser and is secured at its outer edge to a wall that surrounds the diffuser. With the compressor 1 of the present invention, the shroud 6 is secured directly to the top of the diffuser 4. It is not therefore necessary for the shroud 6 to extend beyond the diffuser 4. Indeed, in the embodiment illustrated in the Figures, the shroud 6 and the diffuser 4 have the same outer diameter. As a result, a more compact compressor 1 may be achieved. Additionally, with a conventional compressor, air exiting the diffuser is turned axially by the shroud and wall before exiting the compressor. With the compressor 1 of the present invention, air exiting the diffuser 4 is free to continue flowing in a radial direction. Indeed, the radial outlet of the diffuser 4 may serve as an outlet for the compressor 1. This may then lead to performance benefits since the air exiting the diffuser 4 is not required to turn through 90 degrees. Additionally, a compressor 1 having a radial outlet may better suit the product in which the compressor 1 is intended to be used.

The adhesive 30 used to secure the shroud 6 to the projections 11 has a relatively high viscosity. This then helps ensure that, during the assembly of the compressor 1, the adhesive 30 does not run down the holes 23 and into the diffuser passage, which would then adversely affect the performance of the diffuser 4. Owing to its relatively high viscosity, if the adhesive 30 were applied as a single bead around the trough 26, it is possible that the adhesive 30 would fail to sink into and form a seal around each of the holes 23. Any partially filled holes would then present openings in the diffuser passage through which air would leak. It is for this reason that the sealing ring 7 is employed. The sealing ring 7 forms a sealed enclosure over the top of the holes 23 and the projections 11. Consequently, it is not essential for the adhesive 30 to fill completely each of the holes 23. The sealing ring 7 provides a further benefit during the assembly of the compressor 1. As the sealing ring 7 is pressed into the adhesive 30, the sealing ring 7 drives the adhesive 30 towards the holes 23 and the projections 11 in a generally radial direction. This then helps achieve a good adhesive contact with the projections 11 whilst reducing the risk of driving the adhesive 30 axially down the holes 23 and into the diffuser passage.

In spite of the aforementioned advantages, the sealing ring 7 may conceivably be omitted. For example, in order to ensure that the holes 23 in the shroud 6 are sealed, the trough 26 may be filled with adhesive to a level that ensures that the adhesive completely covers the holes 23 and the projections 11. This would inevitably require a larger volume of adhesive, which would increase the cost of the compressor 1. Additionally, a larger volume of adhesive is likely to take longer to cure, which may have serious implications for mass production. An alternative method would be to apply a single bead of adhesive around the centre of the trough 26 and then spread the adhesive around the trough 26. Care would then be required to ensure that, when spreading the adhesive around the trough 26, the adhesive is not driven down through the holes 23 and into the diffuser passage. Whilst this method would involve a smaller volume of adhesive, it may prove difficult to achieve consistent results when this method is implemented using automated assembly equipment. As a further alternative, a single bead of adhesive might be applied around each and every hole 23. Whilst this would involve a smaller volume of adhesive, the equipment required to automate such a process in a timely fashion would be relatively expensive.

It is not necessary that all vanes 10 of the diffuser 4 carry a projection 11. Indeed, in the embodiment illustrated in the Figures, the diffuser 4 comprises a single vane that does not carry a projection. Conceivably, fewer projections 11 and thus fewer holes 23 may reduce the risk of leaks, if the sealing ring 7 is omitted. Additionally, fewer projections 11 and holes 23 may mean that less adhesive 30 is required to secure the shroud 6 to the diffuser 4. However, it is to be remembered that the pressures generated within the diffuser passage may be relatively high. Accordingly, the number of projections 11 should be sufficient to ensure that the shroud 6 remains secured to the diffuser 4 during operation of the compressor 1.

In the embodiment illustrated in the Figures, each projection 11 extends from the vane 10 along only a part of the vane 10, i.e. the length of each projection 11 is shorter than that of the vane 10. This then has the advantage that the shroud 6 is able to rest on the top of the vanes 10 whilst the projections 11 protrude through the holes 23. However, as noted in the preceding paragraph, it is not essential that all vanes 10 carry a projection 11. Accordingly, the diffuser 4 may comprise vanes that do not carry a projection and vanes that carry a projection having the same length as that of the vane. The diffuser 4 would then appear to comprise short vanes and tall vanes. The shroud 6 would then rest on the short vanes, and the tall vanes would protrude through the holes in the shroud 6.

The diffuser 4 illustrated in the Figures has a single row of radial vanes 10. Conceivably, the compressor 1 might comprise a diffuser having multiple rows of vanes. The vanes of one or more of the rows might then carry projections. Moreover, the compressor 1 might comprise a diffuser having relatively long vanes (e.g. channel diffuser). In this instance, each vane of the diffuser may carry more than one projection.

In the embodiment described above, the frame 3 and the diffuser 4 are provided as two separate components. This was done in order to reduce the cost of the compressor 1. The profile of the diffuser vanes 10 is critical for achieving good pressure recovery. Additionally, since the shroud 6 rests on top of the diffuser vanes 10, the height of the vanes 10 defines the clearance between the shroud 6 and the impeller 5. It is therefore important that the material and process used to manufacture the diffuser 4 are capable of achieving relatively fine detail and tight tolerances. The frame 3, on the other, is used as a support structure. Fine detail and tight tolerances are not therefore required. Consequently, the frame 3 may be manufactured from a material and/or process that are cheaper but unsuitable for the diffuser 4. In the present embodiment, the frame 3 is manufactured from a bulk moulding compound using a casting process. The diffuser 4, on the other hand, is manufactured from a PC/ABS blend using injection moulding. Although manufacturing the frame 3 and diffuser 4 as two separate components has a cost benefit, it will be appreciated that the two might equally be manufactured as a single component.

The invention claimed is:

1. A compressor comprising an impeller, a diffuser and a shroud, wherein the diffuser comprises a plurality of vanes and one or more projections, each projection extends from a top of a vane, the shroud comprises one or more holes, the shroud covers the impeller and the diffuser such that each projection protrudes through a respective hole, and the shroud is secured to the projections by an adhesive; wherein the shroud comprises a pair of concentric walls that delimit a trough within which the holes are located, and the adhesive is located around the trough.

2. The compressor of claim 1, wherein each projection extends from a first part of a vane, and the shroud rests on a second part of the vane.

3. The compressor of claim 1, wherein the compressor comprises a sealing ring that covers the holes and projections, the sealing ring is secured to the shroud by the adhesive, and the adhesive creates a seal between the shroud and the sealing ring around the inner perimeter and the outer perimeter of the sealing ring.

4. A compressor comprising an impeller, a diffuser and a shroud, wherein the diffuser comprises a plurality of vanes and one or more projections, the shroud comprises one or more holes, the shroud covers the impeller and the diffuser such that each projection protrudes through a respective hole, each projection extends from a first part of a vane, the shroud rests on a second part of the vane, and the shroud is secured to the projections by an adhesive;

wherein the shroud comprises a pair of concentric walls that delimit a trough within which the holes are located, and the adhesive is located around the trough.

5. The compressor of claim 4, wherein the compressor comprises a sealing ring that covers the holes and projections, the sealing ring is secured to the shroud by the adhesive, and the adhesive creates a seal between the shroud and the sealing ring around the inner perimeter and the outer perimeter of the sealing ring.

6. A method of assembling a compressor comprising:

providing an impeller, a diffuser and a shroud, wherein the diffuser comprises a plurality of vanes and one or more projections, each projection extends from a top of a vane, and the shroud comprises one or more holes;

covering the impeller and the diffuser with the shroud such that each projection protrudes through a respective hole; and applying an adhesive between the shroud and each projection so as to secure the shroud to the diffuser;

wherein the shroud comprises a pair of concentric walls that delimit a trough within which the holes are located, and the adhesive is located around the trough.

7. The method of claim 6, wherein the method comprises covering the holes and projections with a sealing ring, and the adhesive forms a seal around the inner perimeter and the outer perimeter of the sealing ring.

8. The method of claim 7, wherein the sealing ring comprises an annulus and lips that extend downwardly from the inner perimeter and the outer perimeter of the annulus, and the method comprises pressing the sealing ring into the adhesive such that adhesive is driven towards the projections by the lips.

9. The method of claim 7, wherein the adhesive is applied as a first annular bead and a second annular bead, and the sealing ring contacts the first bead around its outer perimeter and contacts the second bead around its inner perimeter.

* * * * *